US007291579B2

(12) United States Patent
Suzuki et al.

(10) Patent No.: US 7,291,579 B2
(45) Date of Patent: Nov. 6, 2007

(54) THERMAL TRANSFER IMAGE-RECEIVING SHEET

(75) Inventors: Taro Suzuki, Tokyo-To (JP); Masamitsu Suzuki, Tokyo-To (JP); Takenori Omata, Tokyo-To (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 165 days.

(21) Appl. No.: 10/809,917

(22) Filed: Mar. 25, 2004

(65) Prior Publication Data

US 2004/0219312 A1 Nov. 4, 2004

(30) Foreign Application Priority Data

Mar. 28, 2003 (JP) ..... 2003-092343

(51) Int. Cl.
*B41M 5/035* (2006.01)
*B41M 5/50* (2006.01)

(52) U.S. Cl. ..... 503/227; 428/32.39

(58) Field of Classification Search .. 428/32.39–32.52; 503/227

See application file for complete search history.

(56) References Cited

U.S. PATENT DOCUMENTS 6,245,421 B1 6/2001 Aurenty et al.

FOREIGN PATENT DOCUMENTS

EP 0831364 3/1998
EP 1011020 6/2000
JP 3-256785 11/1991

OTHER PUBLICATIONS

Search report issued Jul. 9, 2004 for corresponding European Application No. EP 04 00 7405.

*Primary Examiner*—Bruce H. Hess
(74) *Attorney, Agent, or Firm*—Harness, Dickey & Pierce, P.L.C.

(57) ABSTRACT

There is provided a thermal transfer image-receiving sheet which has none of the offset of an antistatic agent, the transfer of the antistatic agent onto a carrier roll of a thermal printer or the like, a lowering in whiteness, glossiness, and sensitivity in printing of the thermal transfer image-receiving sheet, and a remarkable lowering in coating strength under high-humidity environmental conditions and thus can realize stable and excellent antistatic properties. The thermal transfer image-receiving sheet comprises a substrate sheet and a dye-receptive layer provided on at least one side of the substrate sheet. An electrically conductive layer is provided as at least one layer between the substrate sheet and the receptive layer, or as at least one layer on the substrate sheet in its side remote from the receptive layer. The electrically conductive layer comprises electrically conductive synthetic phyllosilicate. By virtue of the incorporation of the electrically conductive synthetic phyllosilicate in the electrically conductive layer, the electrically conductive layer has good adhesion to the substrate sheet and other layers and has high glossiness, and the thermal transfer image-receiving sheet is free from a change in physical properties such as coating strength upon a change in environmental conditions and has excellent antistatic properties.

5 Claims, No Drawings

THERMAL TRANSFER IMAGE-RECEIVING SHEET

BACKGROUND OF THE INVENTION

1. Field of the Invention

The present invention relates to an image-receiving sheet for thermal transfer recording and particularly to a thermal transfer image-receiving sheet which stably exhibits excellent antistatic properties and is suitable for sublimation dye transfer recording.

2. Background Art

Various thermal transfer recording methods are known in the art. Among others, a thermal sublimation transfer recording method has recently drawn attention. In this method, a thermal transfer sheet comprising a thermal transfer layer containing a sublimable dye provided on a support such as a polyester film is heated by means of a heating medium such as a thermal head or a laser beam to form an image on the thermal transfer image-receiving sheet. The thermal dye transfer recording method is used as information recording means in various fields. According to the thermal dye transfer recording method, full-color images can be formed in a very short time, and high-quality images comparable to full-color photographic images having excellent reproduction of intermediate colors and gradation can be provided.

On the image-receiving face provided are a receptive layer formed of a thermoplastic resin, for example, a saturated polyester resin, a vinyl chloride-vinyl acetate copolymer, a polycarbonate resin or the like from the viewpoint of receiving a sublimable dye being transferred from the thermal transfer sheet and holding the formed image, and, if necessary, an intermediate layer between the substrate sheet and the receptive layer. Intermediate layers include, for example, a layer for imparting cushioning properties, in the case where a high-rigidity substrate sheet such as PET is used, and a layer for imparting antistatic properties. If necessary, a backside layer formed by coating a composition prepared by adding, to a binder such as an acrylic resin, an organic filler of an acrylic resin, a fluororesin, a polyamide resin or the like, or an inorganic filler such as silica may be formed on the backside from the viewpoint of preventing curling and improving slipperiness.

In the case of the so-called "standard-type thermal transfer image-receiving sheet," in use, the image-receiving sheet is viewed by taking advantage of reflected light rather than transmitted light. Also in this case, opaque, for example, white PET, expanded PET, other plastic sheets, natural papers, synthetic papers, or laminates of these materials and the like are used as the substrate sheet. Further, the so-called "seal-type thermal transfer image-receiving sheet" is also used in various applications. The seal-type thermal transfer image-receiving sheet comprises a substrate sheet, a receptive layer provided on one side of the substrate sheet and, provided on the other side of the substrate sheet in the following order, an adhesive layer and a release paper using a pressure-sensitive adhesive or the like. This seal type is used in such a manner that an image is formed on the receptive layer by thermal transfer, the release paper is separated, and the sheet is then applied to any object.

The formation of an antistatic layer formed of a surfactant or the like on the surface of a thermal transfer image-receiving sheet is known. This method suffers from problems including that the thermal transfer image-receiving sheet becomes sticky, the antistatic agent is transferred from the top surface onto the backside, and the antistatic agent is transferred onto a carrier roll or the like of a thermal printer.

Further, these problems lead to a deterioration in antistatic effect with the elapse of time. There is an alternative method in which an electrically conductive layer is formed of an electrically conductive agent, for example, an electrically conductive carbon black or a metal oxide such as tin oxide, and a binder. In order to impart electrically conductive properties by these electrically conductive agents, a considerably large amount thereof should be added. Further, these electrically conductive agents are in many cases inherently colored ones such as black electrically conductive agents. Therefore, basically, when they are used in image-receiving sheets, the whiteness of the image-receiving sheet is lowered making it impossible to use them.

The formation of an antistatic layer formed of acrylic resins having a quaternary ammonium base has also been proposed as a method for solving the above problems. Specifically, Japanese Patent Laid-Open No. 139816/1990 proposes the provision of an antistatic layer, formed of these materials, between the receptive layer and the substrate. Since, however, these materials have poor waterfastness, even when they are used in this way, the coating strength is remarkably deteriorated under high-humidity and/or high-temperature conditions, particularly high-temperature conditions. This poses problems such as breaking of a coating due to friction with a roll during carrying at the time of printing. Further, these materials basically have poor adhesion to the substrate or other resins. Therefore, materials usable herein are considerably limited. Furthermore, the antistatic properties disadvantageously vary depending upon the environment.

Japanese Patent Laid-Open No. 78255/1999 proposes the use of titanium oxide having a surface which has been treated with an electrically conductive material. Since, however, the particle diameter of the electrically conductive material is not less than 1 μm in terms of major axis, the glossiness of the image-receiving paper surface is disadvantageously lowered. Further, since the electrically conductive material used in the surface treatment is a material having a relatively deep color tone such as tin oxide, even when titanium oxide having an inherently white color is used, the color tone is changed to steel-blue upon treatment for rendering the material electrically conductive. As a result, disadvantageously, the whiteness of an image-receiving paper using this electrically conductive material is somewhat deteriorated.

SUMMARY OF THE INVENTION

The present inventors have found that some means can realize a thermal transfer image-receiving sheet which has none of the offset of an antistatic agent, the transfer of the antistatic agent onto a carrier roll of a thermal printer or the like, a lowering in whiteness, glossiness, and sensitivity in printing of the thermal transfer image-receiving sheet, and a remarkable lowering in coating strength under high-humidity environmental conditions and thus can realize stable and excellent antistatic properties.

According to one aspect of the present invention, there is provided a thermal transfer image-receiving sheet comprising: a substrate sheet; and a dye-receptive layer provided on at least one side of the substrate sheet, an electrically conductive layer being provided as at least one layer between the substrate sheet and the receptive layer, said electrically conductive layer comprising electrically conductive synthetic phyllosilicate. According to another aspect of the present invention, there is provided a thermal transfer image-receiving sheet comprising: a substrate sheet; and a dye-receptive layer provided on at least one side of the substrate sheet, an electrically conductive layer being provided as at least one layer on the substrate sheet in its side remote from the receptive layer, said electrically conductive layer comprising electrically conductive synthetic phyllosilicate.

Preferably, the electrically conductive synthetic phyllosilicate has a particle diameter of not more than 30 nm. Preferably, the surface resistivity of the electrically conductive layer per se is $1.0\times10^{4}$ Ω/□ to $1.0\times10^{11}$ Ω/□ under environmental conditions of 23° C./60% and, after the formation of the receptive layer on the electrically conductive layer, the surface resistivity on the receptive layer side is $1.0\times10^{5}$ Ω/□ to $1.0\times10^{13}$ Ω/□ under environmental conditions of 23° C./60%.

According to the present invention, in the thermal transfer image-receiving sheet comprising a substrate sheet and a dye-receptive layer provided on at least one side of the substrate sheet, an electrically conductive layer is provided as at least one layer between the substrate sheet and the receptive layer, or as at least one layer on the substrate sheet in its side remote from the receptive layer. The electrically conductive layer comprises electrically conductive synthetic phyllosilicate. By virtue of the incorporation of the electrically conductive synthetic phyllosilicate in the electrically conductive layer, the electrically conductive layer has good adhesion to the substrate sheet and other layers and has high glossiness, and the thermal transfer image-receiving sheet is free from a change in physical properties such as coating strength upon a change in environmental conditions and has excellent antistatic properties.

DETAILED DESCRIPTION OF THE INVENTION

Embodiments of the present invention will be described.

Substrate Sheet

The substrate sheet functions to hold the receptive layer and, at the same time, preferably can withstand heat applied at the time of image formation and has mechanical properties satisfactory for handling. Materials for such substrate sheets are not particularly limited, and examples thereof include films or sheets of various plastics, for example, polyesters, polyallylates, polycarbonates, polyurethanes, polyimides, polyether imides, cellulose derivatives, polyethylenes, ethylene-vinyl acetate copolymers, polypropylenes, polystyrenes, acrylic polymers, polyvinyl chlorides, polyvinylidene chlorides, polyvinyl alcohols, polyvinyl butyrals, nylons, polyether ether ketons, polysulfones, polyether sulfones, tetrafluoroethylene-perfluoroalkyl vinyl ether copolymers, polyvinyl fluorides, tetrafluoroethylene-ethylene copolymers, tetrafluoroethylene-hexafluoropropylene copolymers, polychlorotrifluoroethylenes, and polyvinylidene fluorides.

Substrate sheets usable herein include: the above plastic films or sheets; white films formed by adding white pigments or fillers to these synthetic resins and forming films from the mixtures; sheets comprising a substrate sheet having in its inside microvoids; and other materials, for example, capacitor papers, glassine papers, parchment papers, synthetic papers, such as polyolefin and polystyrene papers, wood free papers, art papers, coated papers, cast coated papers, synthetic resin- or emulsion-impregnated papers, synthetic rubber latex-impregnated papers, papers with synthetic resin internally added thereto, cellulose fiber papers and the like. Further, laminates of any combination of the above substrate sheets may also be used. Representative examples thereof include a laminate of a combination of a cellulose fiber paper with a synthetic paper and a laminate of a combination of a cellulose fiber paper with a plastic film.

Furthermore, substrate sheets of which the surface and/or the backside have been subjected to easy-adhesion treatment may also be used. In the present invention, when a plastic-based substrate sheet having a high level of antistatic properties is used as the substrate sheet, the effect is particularly significant. However, it should be noted that the substrate sheet is not limited to this plastic-based substrate sheet only. The thickness of the substrate sheet is generally about 3 to 300 μm. In the present invention, the use of a substrate sheet having a thickness of 75 to 175 μm is preferred from the viewpoint of suitable mechanical properties and the like. When the adhesion between the substrate sheet and the layer overlying the substrate sheet is poor, the surface of the substrate sheet is preferably subjected to easy-adhesion treatment or corona discharge treatment.

Electrically Conductive Layer

The electrically conductive layer is formed by dispersing an electrically conductive synthetic phyllosilicate in a binder of a thermoplastic resin. The binder should be selected by taking into consideration the adhesion between the substrate sheet and other layers and the dispersibility of a pigment for color tone regulation. Thermoplastic resins usable herein include, for example, polyolefin resins, polyester resins, urethane resins, polyacrylic resins, polyvinyl alcohol, epoxy resins, butyral resins, polyamide resins, polyether resins, and polystyrene resins. Among them, urethane resins and polyester resins are preferred, for example, from the viewpoints of adhesion to the substrate and dispersibility, and are available from Nippon Synthetic Chemical Industry Co., Ltd. under various tradenames, for example, under the tradename Polyester.

Electrically conductive phyllosilicates usable in the present invention include synthetic products prepared by reacting a sodium, magnesium, or lithium salt with sodium silicate under proper conditions. The particle diameter of the electrically conductive phyllosilicate is preferably not more than 30 nm. Such electrically conductive phyllosilicates are available, for example, from Nippon Silica industrial Co., Ltd. under the tradenames Laponite S and Laponite JS. Naturally occurring mineral-derived materials having a similar structure, such as bentonite and hectorite, are not electrically conductive and have a particle diameter of 300 to 550 nm. Due to these properties, the glossiness of the formed image-receiving sheet is deteriorated.

The addition amount may be mentioned as a factor that determines electrical conductivity. The addition of a small amount of the electrically conductive synthetic phyllosilicate can provide a satisfactory level of electrical conductivity. The electrically conductive synthetic phyllosilicate may be added in an amount of about 1 to 500% by weight based on the resin binder from the viewpoints of dispersibility, stability, and suitability for coating. When the amount of the electrically conductive synthetic phyllosilicate is below the above-defined lower limit, stable electrical conductivity cannot be provided. On the other hand, when the amount of the electrically conductive synthetic phyllosilicate is above the above-defined upper limit, the viscosity of ink is increased. As a result, in some cases, problems such as a deterioration in suitability for coating and a deterioration in adhesion between the electrically conductive layer and other layers including the substrate sheet adjacent to the electrically conductive layer occur.

Therefore, the amount of the electrically conductive synthetic phyllosilicate added is preferably 20 to 200% by weight, most preferably 50 to 200% by weight, based on the resin binder. The coverage of the electrically conductive layer is also one of factors, which determine the electrically conductive layer, and may be in the range of 0.1 to 10 g/m$^2$ on a dry basis. Also in this case, the same problems as experienced in the addition amount occur. For this reason, the coverage of the electrically conductive layer is preferably 0.3 to 5 g/m$^2$, most preferably 0.5 to 3 g/m$^2$. Various pigments, dyes, brightening agents, and other additives may be added to the electrically conductive layer, depending upon whiteness, opaqueness, color matching and other purposes, on such a level that does not sacrifice the electrical conductivity.

Receptive Layer

The receptive layer according to the present invention is provided on at least one side of the substrate sheet. The receptive layer comprises one or more thermoplastic resins. This layer functions to receive a sublimable dye being transferred from a thermal transfer sheet and to hold the formed thermally transferred image. Examples of thermoplastic resins usable in the receptive layer include: halogenated polymers such as polyvinyl chloride and polyvinylidene chloride; vinyl resins such as polyvinyl acetate, ethylene-vinyl acetate copolymer, vinyl chloride-vinyl acetate copolymer, polyacrylic ester, polystyrene, and polystyrene-acryl resin; acetal resins such as polyvinyl formal, polyvinyl butyral, and polyvinyl acetal; various polyester resins such as saturated or unsaturated polyesters; polycarbonate resins; cellulosic resins such as cellulose acetate; polyolefin resins; urea resins; and polyamide resins such as melamine resins and benzoguanamine resins. These resins may be used either solely or as any blend of two or more of them so far as they are compatible with each other.

Among the above thermoplastic resins, those having active hydrogen are preferred. The active hydrogen is preferably present at the end of the thermoplastic resin from the viewpoint of stability of the thermoplastic resins. When a vinyl resin is used, the content of vinyl alcohol is preferably not more than 30% by weight. If necessary, the receptive layer may contain various other additives. Specifically, titanium oxide, zinc oxide, kaolin, clay, calcium carbonate, finely divided silica or other pigments and fillers may be added from the viewpoint of improving the whiteness of the receptive layer to further enhance the sharpness of transferred images. Further, conventional additives such as plasticizers, ultraviolet absorbers, photostabilizers, antioxidants, brightening agents, and antistatic agents may be if necessary added to the receptive layer.

The receptive layer may be formed by mixing the above resin with the above release agent and optional additives or the like, thoroughly kneading the mixture together with a solvent, a diluent or the like to prepare a coating liquid for a receptive layer, coating the coating liquid on the above substrate sheet by forming means, for example, gravure printing, screen printing, or reverse roll coating using a gravure plate, and drying the coating to form a receptive layer. An intermediate layer, a backside layer, and an easy-adhesion layer, which will be described later, may also be formed by using the same forming means as used in the formation of the receptive layer.

The present invention can also be applied to a seal-type thermal transfer image-receiving sheet comprising a substrate sheet, a receptive layer provided on one side of the substrate sheet, and, provided on the other side of the substrate sheet in the following order, an adhesive layer using a pressure-sensitive adhesive or the like and a release paper. The adhesive layer may be formed by using the same forming means as used in the formation of the receptive layer. In order to improve the antistatic properties, the following antistatic agent can be incorporated in the coating liquid for a receptive layer: fatty esters, sulfuric esters, phosphoric esters, amides, quaternary ammonium salts, betaines, amino acids, acrylic resins, ethylene oxide adducts and the like. The amount of the antistatic agent added is preferably 0.1 to 2.0% by weight based on the resin.

In the thermal transfer image-receiving sheet according to the present invention, the coverage of the receptive layer is preferably 0.5 to 4.0 g/m$^2$ on a dry basis. When the coverage is less than 0.5 g/m$^2$ on a dry basis, an image in its highlight part disadvantageously feels rough, for example, due to unsatisfactory adhesion to a thermal head derived from rigidity of the substrate sheet, for example, in the case where the receptive layer is provided directly on the substrate sheet. This problem can be avoided by providing an intermediate layer for imparting cushioning properties. In this case, however, resistance to damage of the receptive layer is lowered. When a high level of energy is applied, the roughness of the surface relatively increases with increasing the coverage of the receptive layer. When the coverage exceeds 4.0 g/m$^2$ on a dry basis, for example, at the time of OHP projection, a high density part is viewed as a somewhat blackish color. In the present invention, the coverage is weight on a solid basis in a dried state, unless otherwise specified.

Backside Layer

A backside layer may be provided on the substrate sheet in its side remote from receptive layer, for example, from the viewpoints of improved carriability and curl prevention of the thermal transfer image-receiving sheet. The backside layer having such a function may be formed of a material prepared by mixing additives, for example, an organic filler such as an acrylic filler, a polyamide filler, a fluorofiller, or polyethylene wax or an inorganic filler such as silicon dioxide or a metal oxide to a resin such as an acrylic resin, a cellulose resin, a polycarbonate resin, a polyvinyl acetal resin, a polyvinyl alcohol resin, a polyamide resin, a polystyrene resin, a polyester resin, or a halogenated polymer.

Further preferably, the backside layer is formed of a material prepared by curing the above resin with a curing agent. Any commonly used conventional curing agent may be used as the curing agent. Among others, isocyanate compounds are preferred. When the resin for the backside layer is reacted with an isocyanate compound or the like to form a urethane bond for curing and three-dimensional structure formation, the heat-resistant storage property and the solvent resistance are improved and, at the same time, the adhesion to the substrate sheet can also be improved. The amount of the curing agent added is preferably 1 to 2 equivalents based on one reactive group of the resin. When the addition amount is less than one equivalent, crosslinking is unsatisfactory and the heat resistance and the solvent resistance are deteriorated. On the other hand, when the addition amount is more than 2, a change in the backside layer with the elapse of time takes place due to the curing agent which stays after the layer formation. Further, in this case, the service life of the coating liquid for the backside layer is disadvantageously shortened.

Further, an organic filler or an inorganic filler may be added as an additive to the backside layer. These fillers function to improve the carriability of the thermal transfer image-receiving sheet through a printer. Further, blocking or other unfavorable phenomena can be prevented to improve storage stability of the thermal transfer image-receiving sheet. Organic fillers include acrylic fillers, polyamide fillers, fluorofillers, and polyethylene wax. Among them, polyamide fillers are particularly preferred. Inorganic fillers include silicon dioxide and metal oxides. The polyamide filler preferably has a molecular weight of 100000 to 900000, is spherical, and has an average particle diameter of 0.01 to 30 μm, and particularly preferably has a molecular weight of 100000 to 500000 and an average particle diameter of 0.01 to 10 μm. Regarding the type of the polyamide filler, as compared with nylon 6 and nylon 66 fillers, nylon 12 fillers are more preferred because, by virtue of excellent waterfastness of the nylon 12 filler, a change in properties upon water absorption does not occur.

The polyamide filler has a high melting point and is thermally stable, has good oil resistance, chemical resistance and other properties, and is less likely to be colored with a dye. A molecular weight of 100000 to 900000 is advantageous in that abrasion hardly occurs, self-lubricating properties can be provided, the coefficient of friction is low, and a counter material, which causes friction with the backside layer, is less likely to be damaged. The average particle diameter is preferably 0.1 to 30 μm. When the particle diameter is below the lower limit of the above-defined range, the filler is disadvantageously hidden in the backside layer and, consequently, satisfactory slipperiness is less likely to be developed. On the other hand, when the particle diameter is above the upper limit of the above-defined range, the particles are significantly protruded from the backside layer. This is disadvantageously likely to enhance the coefficient of friction and to cause dropouts of fillers. The proportion of the filler incorporated in the backside layer is preferably in the range of 0.01 to 200% by weight based on the resin. When the thermal transfer image-receiving sheet is for a reflection image, the amount of the filler incorporated in the backside layer is more preferably 1 to 100% by weight. When the proportion of the filler incorporated in the backside layer is less than 0.01% by weight, the slipperiness is unsatisfactory. As a result, troubles such as a paper jam, for example, at the time of feed of paper into the printer are likely to occur. On the other hand, when the proportion of the filler incorporated in the backside layer exceeds 200% by weight, the slipperiness is excessively high. As a result, the thermal transfer image-receiving sheet is so slippery that a color shift and the like are disadvantageously likely to occur in printed images.

Easy-Adhesion Layer

An easy-adhesion layer may be formed by coating an adhesive resin such as an acrylic ester resin, a polyurethane resin, or a polyester resin on the top surface and/or the backside of the substrate sheet. Alternatively, the adhesion between the substrate sheet and a layer provided on the substrate sheet can be enhanced without the provision of the coating layer by subjecting the top surface of the substrate sheet and/or the backside of the substrate sheet to corona discharge treatment.

EXAMPLES

The following Examples and Comparative Examples further illustrate the present invention.

Example 1

A 100 μm-thick white PET film (Lumirror, manufactured by Toray Industries, Inc.) was provided as a substrate sheet. A coating liquid 1 for an electrically conductive layer having the following composition was coated at a coverage of 2.0 g/m$^2$ on a dry basis on one side of the substrate sheet by means of a Mayer bar, and the coating was dried to form an electrically conductive layer.

| <Coating liquid 1 for electrically conductive layer> | Solid content ratio |
|---|---|
| Electrically conductive synthetic phyllosilicate (Laponite JS, manufactured by Wilbur-Ellis Company) (disk like particles with major axis 25 nm and thickness 0.9 nm) | 10.0 |
| Polyester resin (Polyester WR 905, manufactured by Nippon Synthetic Chemical Industry Co., Ltd.) | 10.0 |
| Water | 80.0 |

Next, a coating liquid 1 for a receptive layer having the following composition was coated at a coverage of 4.0 g/m$^2$ on a dry basis on the surface of the electrically conductive layer, and the coating was dried to form a receptive layer.

| <Coating liquid 1 for receptive layer> | Solid content ratio |
|---|---|
| Vinyl chloride-vinyl acetate copolymer (#1000A, manufactured by Denki Kagaku Kogyo K. K.) | 19.6 |
| Silicone (X62-1212, manufactured by The Shin-Etsu Chemical Co., Ltd.) | 2.0 |
| Catalyst (CAT-PL-50T, manufactured by The Shin-Etsu Chemical Co., Ltd.) | 0.2 |
| Methyl ethyl ketone | 39.1 |
| Toluene | 39.1 |

Next, a coating liquid 1 for a backside layer having the following composition was coated at a coverage of 1.5 g/m$^2$ on a dry basis on the substrate sheet in its side remote from the receptive layer, and the coating was dried to form a backside layer. Thus, a thermal transfer image-receiving sheet of Example 1 of the present invention was prepared.

| <Coating liquid 1 for backside layer> | Solid content ratio |
|---|---|
| Acrylic resin (BR-85, manufactured by Mitsubishi Rayon Co., Ltd.) | 19.8 |
| Nylon filler (MW-330, manufactured by Shinto Paint Co., Ltd.) | 0.6 |
| Methyl ethyl ketone | 39.8 |
| Toluene | 39.8 |

Example 2

A thermal transfer image-receiving sheet of Example 2 of the present invention was prepared in the same manner as in Example 1, except that a coating liquid 2 for an electrically conductive layer having the following composition was used instead of the coating liquid 1 for an electrically conductive layer.

| <Coating liquid 2 for electrically conductive layer> | Solid content ratio |
|---|---|
| Electrically conductive synthetic phyllosilicate (Laponite JS, manufactured by Wilbur-Ellis Company) (major axis 25 nm and thickness 0.9 nm) | 10.0 |
| Polyurethane resin (Hydran AP-40, manufactured by Dainippon Ink and Chemicals, Inc.) | 35.0 |
| Titanium oxide (TCA-888, manufactured by Tohchem Products Corporation) | 5.0 |
| Water | 50.0 |

Example 3

A 100 μm-thick white PET film (Lumirror, manufactured by Toray Industries, Inc.) was provided as a substrate sheet. The coating liquid 1 for an electrically conductive layer as used in Example 1 was coated at a coverage of 2.0 g/m$^2$ on a dry basis on one side of the substrate sheet by means of a Mayer bar, and the coating was dried to form an electrically conductive layer. Next, the coating liquid 1 for a backside layer as used in Example 1 was coated at a coverage of 1.5 g/m$^2$ on a dry basis on the surface of the electrically conductive layer, and the coating was dried to form a backside layer. Further, the coating liquid 1 for a receptive layer as used in Example 1 was coated at a coverage of 4.0 g/m$^2$ on a dry basis on the other side of the substrate sheet, and the coating was dried to form a receptive layer. Thus, a thermal transfer image-receiving sheet of Example 3 of the present invention was prepared.

Comparative Example 1

A thermal transfer image-receiving sheet of Comparative Example 1 was prepared in the same manner as in Example 1, except that a coating liquid 3 for an electrically conductive layer having the following composition was used instead of the coating liquid 1 for an electrically conductive layer.

| <Coating liquid 3 for electrically conductive layer> | Solid content ratio |
|---|---|
| Smectite (LUCENTITE SWN, manufactured by CO-OP CHEMICAL CO., LTD.) (particle diameter: 300 nm) | 10.0 |
| Polyester resin (Polyester WR 905, manufactured by Nippon Synthetic Chemical Industry Co., Ltd.) | 10.0 |
| Water | 80.0 |

Comparative Example 2

A thermal transfer image-receiving sheet of Comparative Example 2 was prepared in the same manner as in Example 1, except that a coating liquid 4 for an electrically conductive layer having the following composition was used instead of the coating liquid 1 for an electrically conductive layer.

| <Coating liquid 4 for electrically conductive layer> | Solid content ratio |
|---|---|
| Electrically conductive synthetic phyllosilicate (Laponite JS, manufactured by Wilbur-Ellis Company) (major axis 25 nm and thickness 0.9 nm) | 10.0 |
| Water | 90.0 |

Comparative Example 3

A thermal transfer image-receiving sheet of Comparative Example 3 was prepared in the same manner as in Example 1, except that, in the coating liquid 1 for an electrically conductive layer, the electrically conductive phyllosilicate was not used.

Comparative Example 4

A thermal transfer image-receiving sheet of Comparative Example 4 was prepared in the same manner as in Example 1, except that a coating liquid 5 for an electrically conductive layer having the following composition was used instead of the coating liquid 1 for an electrically conductive layer.

| <Coating liquid 5 for electrically conductive layer> | Solid content ratio |
|---|---|
| Electrically conductive acicular crystal (FT-1000, manufactured by Ishihara Sangyo Kaisha Ltd.) (average fiber diameter 130 nm, average fiber length 1680 nm) | 20.0 |
| Polyurethane resin (Nippollan N-5199, manufactured by Nippon Polyurethane Industry Co., Ltd.) | 20.0 |
| Methyl ethyl ketone | 25.0 |
| Toluene | 25.0 |
| IPA | 10.0 |

Image formation was carried out using the thermal transfer image-receiving sheets of the Examples of the present invention and Comparative Examples and a commercially available thermal dye transfer sheet by means of a CP-2000 printer manufactured by Mitsubishi Electric Corporation to examine the carriability of the thermal transfer image-receiving sheets. Further, before and after image formation by means of the above printer, the resistivity of the top surface and the backside of the thermal transfer image-receiving sheets is measured. Before the image formation, the whiteness and glossiness of the receptive layer side of the thermal transfer image-receiving sheets are also measured.

Evaluation methods used are as follows.

(Carriability)

For the thermal transfer image-receiving sheet of each of the Examples and Comparative Examples, 10 sheets are provided and were successively carried in the printer to evaluate the carriability. The carriability was evaluated according to the following criteria.

○: No trouble occurred.

X: Jamming occurred in the printer.

(Surface Resistivity)

For the receptive-layer side (top surface) and the backside of the thermal transfer image-receiving sheets before image formation by means of the above printer, the surface resistivity is measured with a high-resistivity measuring device manufactured by Advantest Co., Ltd. under environmental conditions of temperature 23° C., relative humidity 60% and under environmental conditions of temperature 0° C. and unspecified (uncontrolled) humidity. Further, for the receptive-layer side (top surface) and the backside of the thermal transfer image-receiving sheets after image formation by means of the above printer, the surface resistivity is measured with the above resistivity measuring device under environmental conditions of temperature 23° C., relative humidity 60% and under environmental conditions of temperature 0° C. and unspecified (uncontrolled) humidity.

(Whiteness)

For the surface of each of the thermal transfer image-receiving sheets on its receptive layer side, the reflection properties were measured with SPECTRO COLOR METER Model PF-10 manufactured by Nippon Denshoku Co., Ltd.

The results are evaluated according to the following criteria.

○: Whiteness of not less than 80%

X: Whiteness of less than 80%

(Glossiness)

For the surface of each of the thermal transfer image-receiving sheets on its receptive layer side, the specular glossiness was measured with GLOSS METER VG 2000 manufactured by Nippon Denshoku Co., Ltd. according to the method based on JIS Z 8741 at a light beam reflection angle of 45 degrees.

The results are evaluated according to the following criteria.

○: Glossiness of not less than 75%

X: Glossiness of less than 75%

(Adhesion to Substrate)

The adhesion on the electrically conductive layer side of each of the thermal transfer image-receiving sheets was examined by a peeling test with a pressure-sensitive adhesive tape. The pressure-sensitive adhesive tape used was a commercially available mending tape.

The results are evaluated according to the following criteria.

○: Not separated from the substrate.

X: Separated from the substrate.

(Evaluation Results)

The evaluation results are shown in Table 1 below.

TABLE 1

| | Surface resistivity, Ω/□ | | | | | | | | | | | |
|---|---|---|---|---|---|---|---|---|---|---|---|---|
| | Before receptive layer formation Surface resistivity of electrically conductive layer | | After receptive layer formation | | | | | | | | | |
| | | | Before printing | | After printing | | | | | | | |
| | 23° C./60% | 0° C. | 23° C./60% | 0° C. | 23° C./60% | 0° C. | Whiteness, % | Judgment of whiteness | Glossiness, % | Judgment of glossiness | Carriability in printer | Adhesion to substrate |
| Ex. 1 | $6 \times 10^7$<br>Not less than<br>$1 \times 10^{14}$ | $6 \times 10^7$<br>Not less than<br>$1 \times 10^{14}$ | $8 \times 10^9$<br>Not less than<br>$1 \times 10^{14}$ | $8 \times 10^9$<br>Not less than<br>$1 \times 10^{14}$ | $9 \times 10^{10}$<br>Not less than<br>$1 \times 10^{14}$ | $9 \times 10^{10}$<br>Not less than<br>$1 \times 10^{14}$ | 86 | ○ | 81.4 | ○ | ○ | ○ |
| Ex. 2 | $8 \times 10^8$<br>Not less than<br>$1 \times 10^{14}$ | $8 \times 10^8$<br>Not less than<br>$1 \times 10^{14}$ | $1 \times 10^{10}$<br>Not less than<br>$1 \times 10^{14}$ | $1 \times 10^{10}$<br>Not less than<br>$1 \times 10^{14}$ | $1 \times 10^{11}$<br>Not less than<br>$1 \times 10^{14}$ | $1 \times 10^{11}$<br>Not less than<br>$1 \times 10^{14}$ | 89 | ○ | 77.4 | ○ | ○ | ○ |
| Ex. 3 | Not less than<br>$1 \times 10^{14}$ | Not less than<br>$1 \times 10^{14}$ | Not less than<br>$1 \times 10^{14}$ | Not less than<br>$1 \times 10^{14}$ | Not less than<br>$1 \times 10^{14}$ | Not less than<br>$1 \times 10^{14}$ | 86 | ○ | 77 | ○ | ○ | ○ |
| Comp. Ex. 1 | $6 \times 10^7$<br>$8 \times 10^{12}$<br>Not less than<br>$1 \times 10^{14}$ | $6 \times 10^7$<br>$8 \times 10^{12}$<br>Not less than<br>$1 \times 10^{14}$ | $8 \times 10^3$<br>$8 \times 10^{13}$<br>Not less than<br>$1 \times 10^{14}$ | $8 \times 10^3$<br>$8 \times 10^{13}$<br>Not less than<br>$1 \times 10^{14}$ | $9 \times 10^{10}$<br>Not less than<br>$1 \times 10^{14}$<br>Not less than<br>$1 \times 10^{14}$ | $9 \times 10^{10}$<br>Not less than<br>$1 \times 10^{14}$<br>Not less than<br>$1 \times 10^{14}$ | 82 | ○ | 74.6 | X | X | ○ |
| Comp. Ex. 2 | $6 \times 10^7$<br>Not less than<br>$1 \times 10^{14}$ | $6 \times 10^7$<br>Not less than<br>$1 \times 10^{14}$ | $8 \times 10^9$<br>Not less than<br>$1 \times 10^{14}$ | $8 \times 10^9$<br>Not less than<br>$1 \times 10^{14}$ | $9 \times 10^{10}$<br>Not less than<br>$1 \times 10^{14}$ | $9 \times 10^{10}$<br>Not less than<br>$1 \times 10^{14}$ | 86 | ○ | 76.1 | ○ | ○ | X |
| Comp. Ex. 3 | Not less than<br>$1 \times 10^{14}$<br>Not less than<br>$1 \times 10^{14}$ | Not less than<br>$1 \times 10^{14}$<br>Not less than<br>$1 \times 10^{14}$ | Not less than<br>$1 \times 10^{14}$<br>Not less than<br>$1 \times 10^{14}$ | Not less than<br>$1 \times 10^{14}$<br>Not less than<br>$1 \times 10^{14}$ | Not less than<br>$1 \times 10^{14}$<br>Not less than<br>$1 \times 10^{14}$ | Not less than<br>$1 \times 10^{14}$<br>Not less than<br>$1 \times 10^{14}$ | 86 | ○ | 77.3 | ○ | X | ○ |
| Comp. Ex. 4 | $6 \times 10^8$<br>Not less than<br>$1 \times 10^{14}$ | $6 \times 10^8$<br>Not less than<br>$1 \times 10^{14}$ | $7 \times 10^6$<br>Not less than<br>$1 \times 10^{14}$ | $7 \times 10^6$<br>Not less than<br>$1 \times 10^{14}$ | $6 \times 10^7$<br>Not less than<br>$1 \times 10^{14}$ | $6 \times 10^7$<br>Not less than<br>$1 \times 10^{14}$ | 88 | ○ | 72.4 | X | ○ | ○ |

Note)
Numerical value on upper column: surface resistivity of receptive layer side (top surface) of thermal transfer image-receiving sheet.
Numerical value on lower column: surface resistivity of backside of thermal transfer image-receiving sheet.

Upper numerical value represents surface resistivity of the receptive layer side (top surface) of the thermal transfer image-receiving sheet, and lower numerical value represents surface resistivity of the backside of the thermal transfer image-receiving sheet.

As is apparent from the above results, for the thermal transfer image-receiving sheets of Examples 1 to 3 in which an electrically conductive layer is formed, the surface resistivity of the receptive layer and the backside layer of the image-receiving sheet is stable against a change in environmental conditions such as temperature and humidity and has no significant change between before image formation and after image formation. On the other hand, for the thermal transfer image-receiving sheets of Comparative Examples 1 and 3 in which no electrically conductive layer is provided, the surface resistivity is high and is not stable, leading to the occurrence of a paper jam during carrying through a printer which makes it impossible to realize normal image formation.

According to the present invention, as described above, in a thermal transfer image-receiving sheet comprising a substrate sheet and a dye-receptive layer provided on at least one side of the substrate sheet, an electrically conductive layer is provided as at least one layer between the substrate sheet and the receptive layer, or as at least one layer on the substrate sheet in its side remote from the receptive layer. The electrically conductive layer comprises electrically conductive synthetic phyllosilicate. By virtue of the incorporation of the electrically conductive synthetic phyllosilicate in the electrically conductive layer, the electrically conductive layer has good adhesion to the substrate sheet and other layers and has high glossiness, and the thermal transfer image-receiving sheet has none of the offset of an antistatic agent, the transfer of the antistatic agent onto a carrier roll of a thermal printer or the like, a lowering in whiteness of the thermal transfer image-receiving sheet, and a remarkable lowering in coating strength under high-humidity environmental conditions and thus can realize stable and excellent antistatic properties. Thus, the thermal transfer image-receiving sheet according to the present invention exhibits excellent antistatic properties during image formation. Therefore, carrying troubles such as a jam (a paper jam) and double feeding can be prevented. Further, troubles such as print dropouts attributable to attraction of dust or the like can also be prevented.

The invention claimed is:

1. A thermal transfer image-receiving sheet comprising:

a substrate sheet; and a dye-receptive layer provided on at least one side of the substrate sheet, an electrically conductive layer being provided as at least one layer between the substrate sheet and the receptive layer, said electrically conductive layer comprising electrically conductive synthetic phyllosilicate, and an easy-adhesion layer being further provided on one of the top side of the substrate sheet, the back side of the substrate sheet, or both.

2. The thermal transfer image-receiving sheet according to claim 1, wherein the surface resistivity of the electrically conductive layer is $1.0\times10^{4}$ Ω/□ to $1.0\times10^{11}$ Ω/□ under environmental conditions of 23° C./60% and, after the formation of the receptive layer, the surface resistivity on the receptive layer side is $1.0\times10^{5}$ Ω/□ to $1.0\times10^{13}$ Ω/□ under environmental conditions of 23° C./60%.

3. A thermal transfer image-receiving sheet comprising:

a substrate sheet; and a dye-receptive layer provided on at least one side of the substrate sheet, an electrically conductive layer being provided as at least one layer on the substrate sheet in its side remote from the receptive layer, said electrically conductive layer comprising electrically conductive synthetic phyllosilicate, and an easy-adhesion layer being further provided on one of the top side of the substrate, the back side of the substrate sheet, or both.

4. The thermal transfer image-receiving sheet according to claim 1 or 2, wherein said electrically conductive synthetic phyllosilicate has a particle diameter of not more than 30 nm.

5. The thermal transfer image-receiving sheet according to claim 3, wherein the surface resistivity of the electrically conductive layer is $1.0\times10^{4}$ Ω/□ to $1.0\times10^{11}$ Ω/□ under environmental conditions of 23° C./60%.

* * * * *